US009685308B2

(12) United States Patent
Bonucci et al.

(10) Patent No.: US 9,685,308 B2
(45) Date of Patent: Jun. 20, 2017

(54) GETTER PUMPING SYSTEM

(71) Applicant: SAES GETTERS S.P.A., Lainate (IT)

(72) Inventors: Antonio Bonucci, Hamburg (DE); Paolo Manini, Milan (IT); Fabrizio Siviero, Lainate (IT); Piergiorgio Sonato, Padua (IT)

(73) Assignee: SAES GETTERS S.P.A., Lainate (IT)

( * ) Notice: Subject to any disclaimer, the term of this patent is extended or adjusted under 35 U.S.C. 154(b) by 0 days.

(21) Appl. No.: 15/308,057

(22) PCT Filed: Jun. 24, 2015

(86) PCT No.: PCT/IB2015/054728
§ 371 (c)(1),
(2) Date: Oct. 31, 2016

(87) PCT Pub. No.: WO2015/198235
PCT Pub. Date: Dec. 30, 2015

(65) Prior Publication Data

US 2017/0076925 A1 Mar. 16, 2017

(30) Foreign Application Priority Data

Jun. 26, 2014 (IT) ..... MI2014A1157

(51) Int. Cl.
*F04B 37/02* (2006.01)
*H01J 41/12* (2006.01)
(Continued)

(52) U.S. Cl.
CPC ..... *H01J 41/12* (2013.01); *F04B 37/02* (2013.01); *F04B 37/14* (2013.01); *H01J 41/20* (2013.01)

(58) Field of Classification Search
CPC ..... H01J 41/12; F04B 37/04; F04B 37/06
(Continued)

(56) References Cited

U.S. PATENT DOCUMENTS 3,662,522 A * 5/1972 Della Porta ..... H01J 41/12 417/51
5,154,582 A 10/1992 Danielson
(Continued)

FOREIGN PATENT DOCUMENTS

EP 0742370 A1 5/1996
EP 0906635 A1 4/1999
(Continued)

OTHER PUBLICATIONS

International Search Report and Written Opinion for International Application No. PCT/IB2015/054728 filed Jun. 24, 2015 on behalf of SAES GETTERS S.P.A. Mail Date: Oct. 8, 2015. 9 pages.
(Continued)

*Primary Examiner* — Charles Freay
(74) *Attorney, Agent, or Firm* — Steinfl + Bruno LLP

(57) ABSTRACT

Getter pumping system particularly useful for linear accelerators or more generally high-volume environments, wherein a plurality of getter cartridges (100, 100', 100'', . . . 100$^{n}$) having a linear support (110, 110', 110'', . . . 110$^{n}$) and a plurality of linear heaters (120, 120', . . . 120$^{n}$) are connected in a high-density configuration to a wall (11) that has a surface area of at least 0.5 m$^2$.

13 Claims, 2 Drawing Sheets

Figure 1:
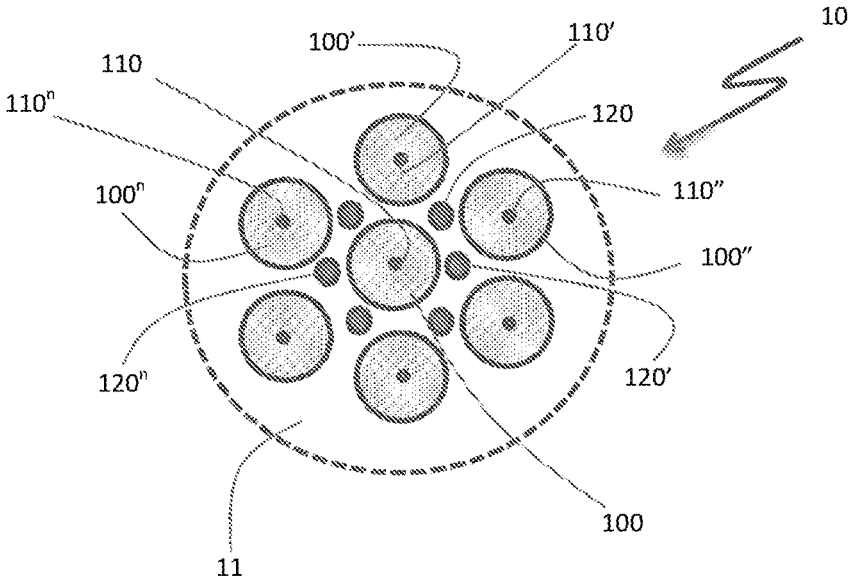

(51) Int. Cl.
*F04B 37/14* (2006.01)
*H01J 41/20* (2006.01)

(58) Field of Classification Search
USPC ..... 417/51
See application file for complete search history.

(56) References Cited

U.S. PATENT DOCUMENTS 5,772,404 A * 6/1998 Carella ..... F04B 37/02 417/313
5,911,560 A 6/1999 Krueger et al.
5,993,165 A * 11/1999 Lorimer ..... C23C 14/54 417/48
6,149,392 A 11/2000 Conte
6,309,184 B1 * 10/2001 Moraja ..... F04B 37/02 417/199.1
6,468,043 B1 10/2002 Benvenuti
6,554,970 B1 4/2003 Benvenuti
9,541,078 B2 * 1/2017 Bonucci ..... F04B 37/02
2002/0037633 A1 3/2002 Satou et al.
2012/0014814 A1 1/2012 Bonucci et al.

FOREIGN PATENT DOCUMENTS

EP 0964741 A1 12/1999
EP 2409034 A1 1/2012
WO 2013/175340 A1 11/2013
WO 2014/060879 A1 4/2014

OTHER PUBLICATIONS

International Preliminary Report on Patentability for International Application No. PCT/IB2015/054728 filed Jun. 24, 2015 on behalf of SAES GETTERS S.P.A. Mail Date: Sep. 27, 2016. 17 pages.
Ferrario et al. "Distributed Pumping by Non-Evaporable Getters in Particle Accelerators" IEEE Transactions on Nuclear Science, Jun. 1981, vol. NS-28, No. 3, pp. 3333-3335.

* cited by examiner

GETTER PUMPING SYSTEM

The present invention relates to an improved getter pumping system, particularly useful for linear accelerators or more generally for high-volume environments to be evacuated such as large UHV/HV machines for thin film deposition processes like sputtering or vacuum process, for semiconductor manufacturing as dry etching, ion implant or for large detectors kept in vacuum. Another application is the control of residual gas pressure, as for instance $H_2$ and its isotopes, in specific chambers of nuclear energy systems, in particular fusion-based systems.

Generally speaking, getter-based solutions for vacuum control in high-volume environments fall into two main categories.

The first one is for example described in EP 0964741 and EP 0906635, and consists in a thin film coating of essentially the whole metallic surface of metal chambers.

The second solution widely diffused, consists instead in using a plurality of getter pumps distributed along the perimeter of an accelerator and connected thereto by means of suitable openings. This solution is described in various references, see for example the paper by Ferrario et al., "Distributed pumping by non-evaporable getters in particle accelerators", IEEE transaction on nuclear science, Vol. 28, Nr. 3, June 1981.

Getter pumps are discrete systems envisioning the use of getter cartridges, and they may be used as stand-alone systems, as described in the U.S. Pat. No. 6,149,392, in the applicant's name, showing a standard pumping system with a limited and small number of getter cartridges. In this known system the getter cartridges are contained in a vacuum-tight closed housing, whereas in the present invention they are mounted on a wall chamber without any further holding/containing case.

Alternatively getter pumps may be jointly used with other vacuum pumps, see for example EP 2409034 and WO 2014/060879, both in the applicant's name, for the latest developments on these pumping systems.

Another alternate solution has been described in U.S. Pat. No. 5,911,560 showing the use of a discrete getter pump within a vacuum deposition chamber.

The purpose of the present invention is to improve the performance of prior art getter pumping systems by providing higher overall capacity and/or pumping speed, more specifically a pumping system according to the present invention achieves a pumping speed for $H_2$ higher than $10^5$ l/s and a capacity higher than $10^5$ mbar liter for residual gases as CO, $H_2O$.

In a first aspect thereof the invention consists in a getter pumping system comprising a wall portion, a plurality of getter cartridges having a linear support connected to said wall portion and a plurality of linear heaters wherein said wall portion has a surface area of at least 0.5 $m^2$ the density of getter cartridges is comprised between 20 and 2500 cartridges per square meter and the density of linear heaters is comprised between 20 and 5000 heaters per square meter.

This wide variation in the number of getter cartridges and heaters takes into account the different possibilities for getter cartridges embodiments, each cartridge containing one or more getter elements. This variation is associated with the getter elements geometries (the most common configurations being disk, square and folded planar strip) as well as the getter cartridge upper area, which is defined as the projection of the uppermost getter element of a getter cartridge on a plane perpendicular to the getter cartridge linear support, that typically spans from 1.5 to 15 $cm^2$.

The variation is related also to the different cartridge spacing with respect to each other. In a preferred embodiment the number of getter cartridges per square meter multiplied by the average getter cartridge upper area expressed in square meters is comprised between 0.04 and 0.7. Preferably all the getter cartridges are identical, i.e. they have the same number of getter elements per cartridge, the same getter elements geometries and the same area. Due to the unavoidable variation and tolerances on real products, the average getter cartridge upper area is used in the above consideration on the preferred getter cartridge density.

Figure 2:
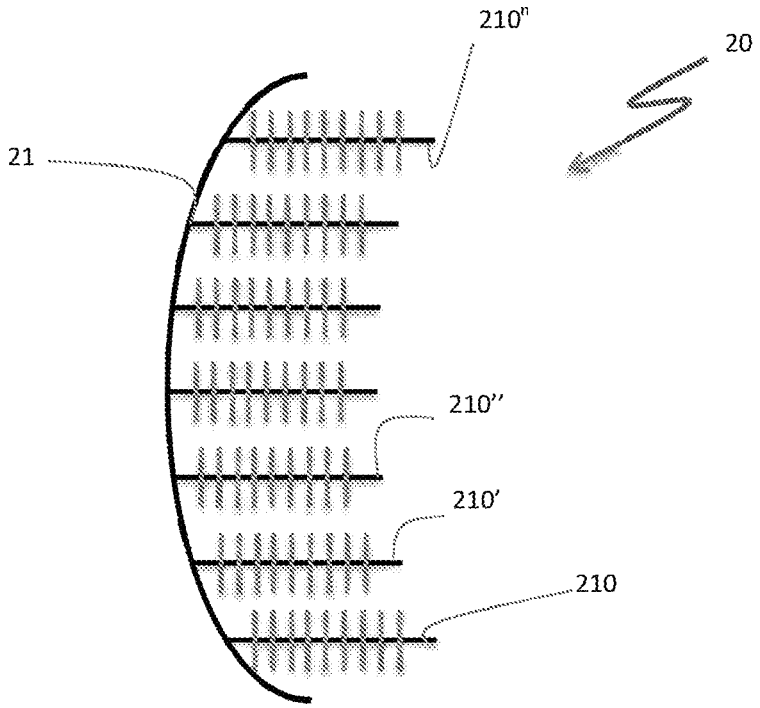
Figure 3:
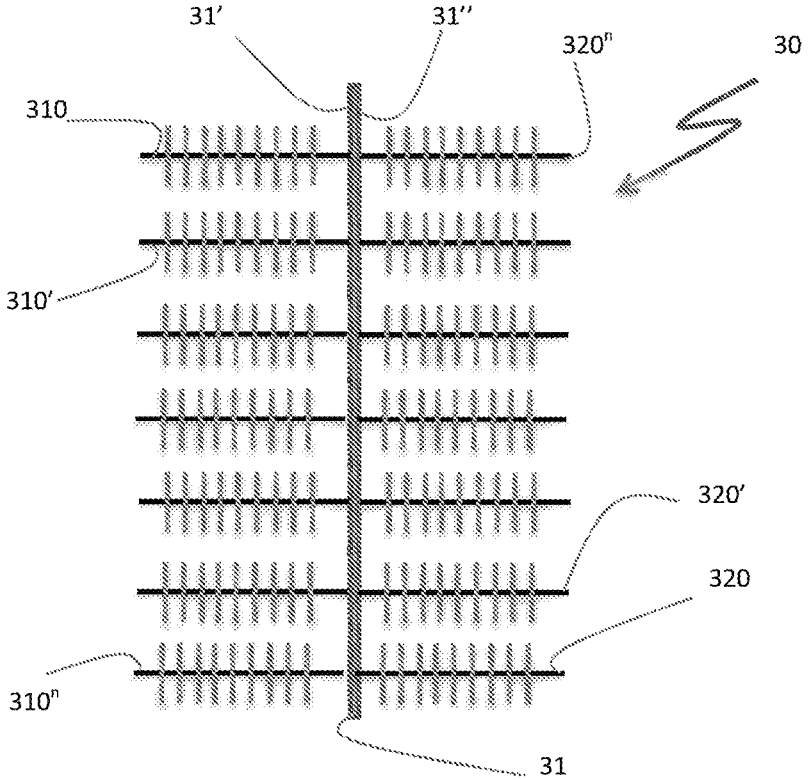

The invention will be further illustrated with the help of the accompanying figures where:

FIG. 1 shows a view from above of a portion of a getter pumping system according to the present invention, FIG. 2 shows a side view of another preferred embodiment for a getter pumping system according to the present invention, and FIG. 3 shows an alternate preferred embodiment for a getter pumping system according to the present invention.

In the previous figures dimensions and dimensional ratios of the depicted elements may not be correct and in some cases have been altered in order to improve the figure readability, moreover elements non-essential to the understating of the invention, such as power supplies and their connecting cables, have not been represented.

It is important to underline that the term "getter cartridge" in the context of the present invention is to be intended as any elongated element containing or holding at least 1.5 grams of getter material. Preferably the amount of getter material per cartridge is equal to or less than 500 grams.

As "elongated element" in the getter cartridge context, we consider an integration of getter material on the linear support where the ratio between the maximum distance of the getter material from the linear support and the length of the linear support is lower than 1.4. In particular, the holding configuration is typically obtained by attaching spaced disks of sintered getter powders to a central element, and such configuration is shown for example in the above-mentioned U.S. Pat. No. 6,149,392 in the applicant's name, whose teachings are herein incorporated by reference.

Another alternate configuration for the getter cartridges according to the present invention envisions the use of pills of getter material contained in an enclosure comprising a metallic netted structure whose purpose is both to retain the pills as well as released particles, if any. Moreover, the porosity of the netted structure can be designed to modulate the throughput of the sorbed gases in combination with other pumps such as a cryogenic or sputter ion pump. In this way, transient peak pressure can be managed in a suitable way. Such getter cartridge structure, even if in a bulkier configuration, is for example described in U.S. Pat. No. 5,154,582.

Therefore in the case of getter disks it is the diameter of the disk that sets the maximum distance of the getter material from the linear support, while in the case of discrete getter elements (pills), the distance is determined by the outermost elements. It is to be remarked that these two are the two most interesting and common configurations, especially the one envisioning the use of getter disks mounted on a central support, but other configurations for the getter cartridges are possible and encompassed by the present invention. For example page 228 of the book "Capture Pumping Technology" (1991) describes another type of getter cartridge in which the getter material is supported on planar substrates; this pump is available on the market and sold by Applicant under the tradename of Sorb-AC. Also in this latter case the outermost edges of the coated getter strips determine the maximum distance for the linear getter cartridge as defined above.

The getter pumping systems according to the present invention envision the presence of heaters to reactivate the getter cartridges. These heaters can be integrated into the getter pumping systems according to the present invention in two main modalities. In the first one the heaters are linear elements separate and distinct from the getter cartridges, in the second one the heaters are embedded in the getter cartridges themselves.

For example, in the case of cartridges made up of stacked and spaced getter disks the heater can be the linear metallic support on which the getter disks are mounted.

Embedded heaters in getter cartridges made with getter materials having a high thermal capacity may not be sufficient to achieve activation and operative conditions in reasonable timeframes, especially for bigger or spread-out systems, therefore in these cases it is envisioned to use also external (to the getter cartridge) and separate heaters.

It is also possible to envision mixed situations in which some of the getter cartridges have linear supports that act as heaters for the supported getter elements as well as for the nearby getter cartridges, whereby not all the getter cartridges are supported by heaters, or a situation in which there are further heaters in addition to the ones embedded in the cartridges.

It should also be noted that the invention is not limited to a specific getter material, but any suitable material capable to sorb gases by means of a thermal treatment may be employed and falls within the definition of getter materials for the scope and purposes of the present invention. The knowledge and characteristics of such materials are available to a person skilled in the art and may be easily retrieved from various sources, such as EP 0742370. Particularly advantageous are getter metals or alloys comprising at least 30% of one or more of titanium, zirconium, yttrium. Even more preferred materials are Zr—Ti—V alloys as described in WO 2013/175340 in the applicant's name or Zr—Ti—V—Al alloys as described in the unpublished Italian patent application number MI2013A001921 also in the applicant's name.

The getter pumping systems according to the invention present an optimal ratio between the number of getter cartridges and the number of heaters, in particular said ratio is preferably comprised between 0.66 and 4.

The preferred orientation of the linear elements that constitute the getter pumping system according to the present invention, being them getter cartridges or linear heaters, is such that the average angle formed by adjacent linear elements is preferably equal to or less than 30°, preferably equal to or less than 15°.

In a preferred embodiment the elements of the getter pumping system according to the present invention, being them heaters, getter cartridges, or getter cartridges with integrated heater, are separately replaceable (i.e. separately connected to the wall).

Preferred connections are achieved by means of screws, junction pockets, interlocking, but also non separately replaceable connections such as welding and riveting may be employed.

In an alternate preferred embodiment the getter pumping system is made up of a plurality of platform subassemblies, each containing between 2 and 10 linear cartridges and between 1 and 11 linear heaters.

FIG. 1 shows a view from above of a portion 10 of a getter pumping system according to the present invention which is made up of a number n of portions like the one represented in FIG. 1, so as to form a "honeycomb" type structure which is one of the favourite structures. In this preferred configuration a central getter cartridge 100 is surrounded by other getter cartridges 100', 100", . . . 100$^n$ and linear heaters 120, 120', . . . 120$^n$ all mounted on a wall 11, each getter cartridge being made up of a plurality of getter disks (only the top one being visible in the view from above) mounted on a central linear element 110, 110', 110", . . . 110$^n$. Said configuration envisions getter cartridges made of disks and separate and distinct linear heaters but, as previously mentioned, this configuration could be alternatively made with getter cartridges in which the getter material is in the form of pills, or getter cartridges in which the central linear supporting elements act also as heaters.

FIG. 2 shows a side view of a getter pumping system 20 according to the present invention, where a plurality of getter cartridges 210, 210', . . . 210' are mounted on a wall section 21 and in which the central linear supporting elements act also as heaters. As it is possible to observe from FIG. 2, the wall section 21 on which the getter cartridges (and optional additional external heaters) are mounted may be curved, such as in the case of particle accelerators.

The side view of an alternate embodiment of a getter pumping system 30 according to the present invention is shown in FIG. 3. In this case there is a linear vertical wall 31 that on both its left surface 31' and right surface 31" carries a plurality of getter cartridges 310, 310', . . . 310" and 320, 320', . . . 320' respectively, in which the central linear supporting elements act also as heaters.

Similarly to the embodiment shown in FIG. 1, both the embodiments shown in FIGS. 2 and 3 could comprise other types of getter cartridges, such as the type using getter pills, and linear heaters external to the getter cartridges.

Also, the getter pumping systems according to the present invention may be used jointly with standard vacuum pumps such as cryogenic, titanium sublimation and sputter ion pumps or getter pumps both connected to the chamber/volume containing the getter pumping system according to the present invention, or as auxiliary elements within the chamber/volume itself.

In a second aspect thereof the invention consists in a method for evacuating a 20 chamber having an internal nominal surface of at least 10 m2 by mounting therein a plurality of getter cartridges having a linear support and a plurality of linear heaters on a wall, wherein said wall has a surface area of at least 0.5 m2, the density of getter cartridges is comprised between 20 and 2500 cartridges per square meter and the density of linear heaters is comprised between 20 and 5000 heaters per square meter.

The invention claimed is:

1. An open getter pumping system comprising:

a wall portion of a chamber, a plurality of getter cartridges having respective linear supports connected via one end of the respective linear supports to said wall portion without a holding or a containing case, and a plurality of linear heaters connected, via a respective one end of each of the plurality of linear heaters, to said wall portion, said linear heaters coinciding with or being separate from said linear supports, wherein said wall portion to which said linear supports and linear heaters are connected has a surface area of at least 0.5 $m^2$, a density of said getter cartridges is comprised between 20 and 2500 cartridges per square meter and a density of said linear heaters is comprised between 20 and 5000 heaters per square meter.

2. The open getter pumping system according to claim 1, wherein a number of getter cartridges per square meter multiplied by an average getter cartridge upper area expressed in square meters is comprised between 0.04 and 0.7.

3. The open getter pumping system according to claim 2, wherein a ratio between the number of getter cartridges and the number of linear heaters is comprised between 0.66 and 4.

4. The open getter pumping system according to claim 1, wherein the amount of getter material per cartridge ranges from 1.5 to 500 grams.

5. The open getter pumping system according to claim 1, wherein the getter cartridges comprise stacked disks of getter materials.

6. The open getter pumping system claim 1, wherein the linear heaters coincide with the linear supports of the getter cartridges.

7. The open getter pumping system according to claim 1, wherein the linear heaters are separate from the linear supports and interspersed among the getter cartridges.

8. The open getter pumping system according to claim 1, wherein an angle formed by adjacent linear supports, adjacent linear heaters or adjacent linear heaters and linear supports is equal to or less than 15°.

9. The open getter pumping system according to claim 1, wherein each of said getter cartridges and each of said linear heaters are separately removable.

10. The open getter pumping system according to claim 1, wherein the getter pumping system comprises a plurality of platform subassemblies each containing between 2 and 10 getter cartridges and between 1 and 11 linear heaters.

11. A method for evacuating a chamber having an internal surface of at least 10 $m^2$, the method comprising:

providing a plurality of getter cartridges having respective linear supports and a plurality of linear heaters, said linear heaters coinciding with or being separate from said linear supports; and mounting, without a holding or containing case, the respective linear supports, via one end of said linear supports, and the plurality of linear heaters, via one end of said linear heaters, on a wall of a chamber, wherein said wall has a surface area of at least 0.5 $m^2$, a density of said getter cartridges is comprised between 20 and 2500 cartridges per square meter and a density of said linear heaters is comprised between 20 and 5000 heaters per square meter.

12. The method according to claim 11, wherein the number of getter cartridges per square meter multiplied by the average getter cartridge upper area expressed in square meters is comprised between 0.04 and 0.7.

13. An open getter pumping system comprising:

a wall portion of a chamber, the wall potion having a first wall surface and a second wall surface opposite the first wall surface, a first plurality of getter cartridges having respective first linear supports connected, without a holding or containing case, to the first wall surface via one end of the respective first linear supports, the first linear supports acting as linear heaters, and a second plurality of getter cartridges having respective second linear supports connected, without a holding or containing case, to the second wall surface via one end of the respective second linear supports, the second linear supports acting as linear heaters, wherein each said first wall surface and second wall surface to which said first and second linear supports are respectively connected has a surface area of at least 0.5 $m^2$, and a density of said getter cartridges is comprised between 20 and 2500 cartridges per square meter.

* * * * *